US005735438A

United States Patent [19]

Ostrowsky

[11] Patent Number: 5,735,438

[45] Date of Patent: Apr. 7, 1998

[54] PRESS-TO-OPEN DISPENSING CLOSURE

[76] Inventor: Efrem Ostrowsky, 2775 Fort Sheridan Ave., Highland Park, Ill. 60035

[21] Appl. No.: 638,096

[22] Filed: Apr. 26, 1996

[51] Int. Cl.[6] ..... B65D 47/08

[52] U.S. Cl. ..... 222/153.06; 222/498; 222/517; 222/556

[58] Field of Search ..... 222/153.05, 153.06, 222/153.07, 498, 517, 505, 556

[56] References Cited

U.S. PATENT DOCUMENTS

| | | | |
|---|---|---|---|
| 2,696,935 | 12/1954 | Obeck | 222/498 |
| 3,739,957 | 6/1973 | Alpern | 222/556 |
| 3,850,350 | 11/1974 | Towns et al. | 222/556 |
| 4,236,656 | 12/1980 | Perrella | 222/517 |
| 4,607,768 | 8/1986 | Taber et al. | 222/517 X |
| 4,901,892 | 2/1990 | Song | 222/498 |
| 4,911,337 | 3/1990 | Rosenthal | 222/498 |
| 5,257,724 | 11/1993 | Campbell | 222/498 X |
| 5,655,685 | 8/1997 | Carr et al. | 222/153.06 X |

FOREIGN PATENT DOCUMENTS

| | | | |
|---|---|---|---|
| 0320905 | 6/1989 | European Pat. Off. | 222/498 |
| 0611167 | 8/1994 | European Pat. Off. | 222/498 |
| 672986 | 5/1952 | United Kingdom | 222/498 |

*Primary Examiner*—Kevin P. Shaver
*Attorney, Agent, or Firm*—John R. Hoffman

[57] ABSTRACT

A dispensing closure system is provided for a container having an opening through which the contents of the container are dispensed. A unitary operating structure is mounted on one side of the opening and includes first and second arms connected together by an integral hinge at adjacent ends of the arms. The opposite ends of the arms are secured to the container at spaced apart pivots. The arms and the hinge are constructed and arranged to permit the arms and the hinge to be moved between a first stable position with the hinge disposed outside a line passing through the spaced apart pivots and a second stable position with the hinge disposed inside the line. A closure member is fixed to one of the arms for pivotal movement between a first position closing the opening when the arms and the hinge are in the first stable position, and a second position spaced outwardly of the opening when the arms and the hinge are in the second stable position. Therefore, the closure member is opened by pushing inwardly on the arms of the operating structure in a direction opposite the opening direction of the closure member.

24 Claims, 3 Drawing Sheets

PRESS-TO-OPEN DISPENSING CLOSURE

FIELD OF THE INVENTION

This invention generally relates to the art of dispensing closures and, particularly, to a dispensing closure which is very easy to manipulate yet of a child resistant character.

BACKGROUND OF THE INVENTION

There are a wide variety of dispensing closures designed to achieve particular functions. Of course, the primary function of the closure is to move between open and closed positions. Often the closure is mounted on a cap which, in turn, is secured to a container about an opening through which the contents of the container are dispensed.

An early problem in designing dispensing closures involved the degree of difficulty in manually opening and closing the closures. In other words, the most undesirable closures obviously require the most manual dexterity. Such closures are highly undesirable for use by individuals with inhibited manual dexterity, such as older individuals, or any individuals having inflictions such as arthritis.

More recent dispensing closures have addressed the safety problem of designing the closures to be child proof or at least child resistant in character. Many safety devices simply have compounded the first problem by making the closures more difficult to manually manipulate and very undesirable for use by the elderly or any other individuals with manual dexterity inflictions.

One approach to providing a child resistant dispensing closure is to design the closure with no edges or surfaces which can be grasped by a child to lift or open the closure. Some sort of mechanism is provided for opening the closure by depressing actions or inwardly directed forces. In other words, a young child cannot associate opening a closure by actions directly opposite to the direction of lifting or opening of the closure. However, most such mechanisms have a limited range of opening motion and, consequently, such closures most often have been used for dispensing only liquids.

A good example of these types of closures is shown in U.S. Pat. No. 4,047,495 dated Sep. 13, 1977. That patent shows a child resistant dispensing closure which is void of any lips, flanges or other structure which can be manually engaged by a child to open the closure. The closure is opened by pushing inwardly on a hinge of the closure. However, as with much of the prior art, the range of movement of the closure is quite limited. As stated in the patent, once the initial movement is effected by the inwardly directed forces, the closure still must be manually engaged and/or engaged with an appropriate manipulative tool so as to move the closure to its fully open position. In other words, while the closure might be child resistant in character, it is highly undesirable for use by individuals having manual dexterity problems.

The present invention is directed to solving the above myriad of problems by providing a dispensing closure which is child resistant in character, extremely simple to manipulate even by individuals with manual dexterity problems, with the closure having a full range of opening motion, and with an arrangement to hold the closure in either of two stable positions defining the open and closed positions of the closure.

SUMMARY OF THE INVENTION

An object, therefore, of the invention is to provide a new and improved dispensing closure system for a container having an opening through which the contents of the container are dispensed.

In the exemplary embodiment of the invention, a unitary operating structure is mounted on one side of the opening in the container and includes first and second arms connected together by an integral hinge at adjacent ends of the arms. The opposite ends of the arms are secured to the container at spaced apart pivots. The arms and the hinge are constructed and arranged to permit the arms and the hinge to be moved between a first stable position with the hinge disposed outside a line passing through the spaced apart pivots, and a second stable position with the hinge disposed inside the line passing through the spaced apart pivots. A closure member is fixed to one of the arms for pivotal movement between a first position closing the opening in the container when the arms and the hinge are in the first stable position, and a second position spaced outwardly of the opening when the arms and the hinge are in the second stable position. Therefore, the closure member is opened by pushing inwardly on the arms of the operating structure in a direction opposite the direction of opening of the closure member.

As disclosed herein, the operating structure, including the arms and the hinge thereof, is unitarily molded of plastic material such as polyolefin, preferably polypropylene. The closure member is molded integrally with the one arm and projects on the opposite side of the pivot for that arm. The arms are gradually thinner in cross section for at least part of the distance from the pivot ends of the arms to the hinge. In the preferred embodiment, the container includes a bottle and a cap, with the opening being in the cap, and with the unitarily molded operating structure being mounted on the cap. The entire operating structure, including the arms and the hinge thereof, as well as the integral closure member are easily mounted on the cap by a snap-latch means including pivot detents snapped into pivot recesses. This operating structure may also be molded partially in its assembled position attached at one end to the cap in an integrally molded one-piece construction.

The dispensing closure system of the invention is readily applicable for use with tamper indicating means, such as a tear-away tamper proof band interconnected between the closure member and the cap or container. An independent tear-away tamper proof band might also be interconnected between the cap and the bottle of the container. Alternately, the cap may be tightly snapped onto the bottle by interlocking beads on the cap and the bottle, without the use of screw threads.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 2:
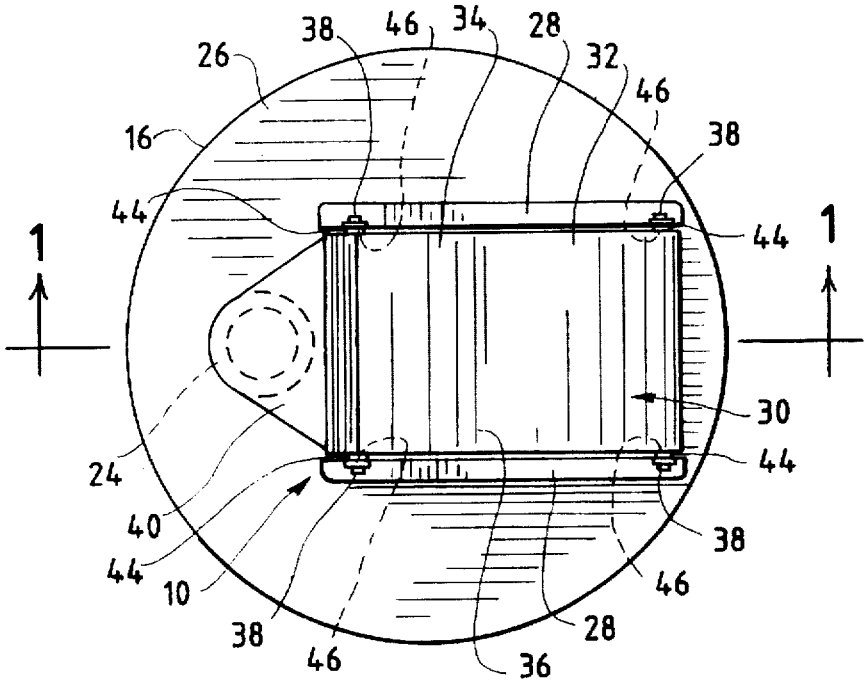
FIG. 2 is a top plan view of the container and dispensing closure system.
Figure 1:
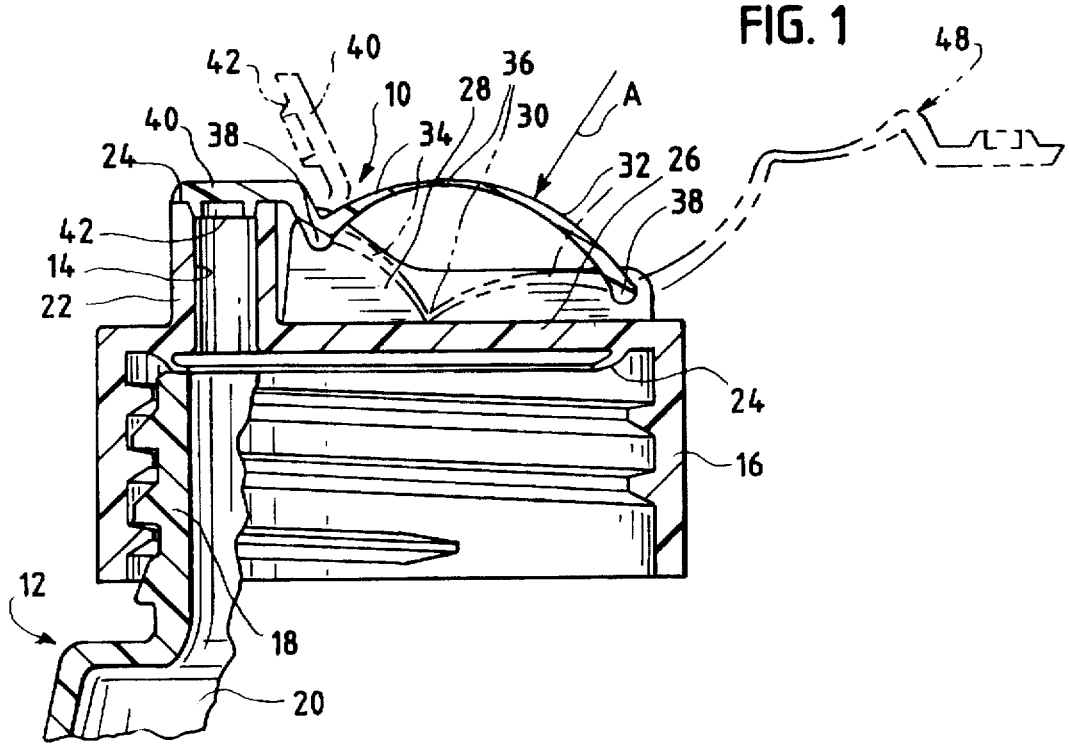
FIG. 1 is a vertical section through the top of a container incorporating the dispensing closure system of the invention.

Referring to the drawings in greater detail, and first to FIGS. 1 and 2, the invention is embodied in a dispensing closure system, generally designated 10, for a container, generally designated 12, having an opening 14 through which the contents of the container are dispensed. It should be understood immediately that the use of the term "container" herein and in the claims hereof is not to be intended as limiting in structure. The container herein is shown as including a cap 16 threaded, snapped on or otherwise secured to a neck 18 projecting upwardly of a bottle 20. However, the dispensing closure system of the invention is equally applicable for use with a variety of containers wherein the cap may not be independent of the bottle, and the dispensing closure system might be used to open and close an opening formed integral with the bottle or other containing device.

With that understanding, as stated, cap 16 is threaded onto neck 18 of bottle 20, and opening 14 is formed at the top of a spout 22 projecting upwardly from the top of the cap. The spout defines an upper circular rim 24. Cap 16 may be molded of relatively rigid plastic material, but including a somewhat flexible sealing lip 24 on the inside of a top wall 26 of the cap for sealing about the top rim of neck 18 of the bottle. Lastly, a pair of generally parallel, upstanding walls 28 are molded integrally with top wall 26 on the outside thereof for mounting the major components of the dispensing closure system therebetween.

The dispensing closure system 10 of the invention includes a unitary operating structure, generally designated 30, which includes first and second arms 32 and 34, respectively, connected together by an integral hinge 36 at adjacent ends of the arms. Opposite ends of arms 32 and 34 are secured between upstanding walls 28 of cap 16 to define pivots 38. A closure member 40 is fixed to the pivoted end of arm 34 for movement between a closed position shown in full lines in FIG. 1 and an open position shown in dotted lines in FIG. 1. In its closed position, closure member 40 is biased against rim 24 at the top of spout 14, and a tapered sealing boss 42 on the underside of the closure member extends into and seals opening 14 within spout 22. It is understood that other sealing methods may be used to prevent leakage, for example plug seals, liners, gaskets or the like.

As best seen in FIG. 2, the unitary operating structure 30, along with closure member 40, is mounted between upstanding walls 28 by a snap-latch means which includes four pivot detents 44 projecting outwardly from the operating structure into pivot recesses 46 on the inside of the upstanding walls to define the four pivots 38, as shown.

The entire unitary operating structure 30, including arms 32 and 34 and hinge 36, as well as closure member 40, is unitarily molded of plastic material such as polyolefin, preferably polypropylene. As best seen in FIG. 1, arms 32 and 34 are molded to taper at least for part of the distance from their pivot ends toward hinge 36. In other words, the arms are gradually thinner in cross section for at least part of the distance from the ends of the arms at pivots 38 toward hinge 36.

The dispensing closure system is assembled by taking the unitarily molded structure, as at 48 in FIG. 1, and snapping pivot detents 44 at the distal end of arm 32 into their respective pivot recesses 46. The entire molded structure then can be rotated toward spout 22 to snap pivot detents 44 at the pivot end of arms 34 into their respective pivot recesses 46. The dispensing closure system then will be in the position shown in full lines in FIG. 1 and 2.

In operation of the dispensing closure system 10, a user simply pushes on arm 32 generally in the direction of arrow "A" inwardly toward the container. This causes arms 32 and 34 and hinge 36 to move between an initial or first stable position (shown in full lines) with hinge 36 disposed outside a line passing through the spaced apart pivots 38 at opposite ends of the arms, to a second stable position (shown in dotted lines) with the hinge disposed inside the line passing through the spaced apart pivots 38 at the ends of the arms. These two stable positions are shown clearly by comparing the full-line position of arms 32 and 34 and closure 40 in FIG. 1, with the dotted-line position of the arms and closure member. It can be seen in comparing these two positions in FIG. 1 that there is a large angular range of movement of closure member 40, whereby the closure member substantially clears the entire extended profile of opening 14 of spout 22. During operation, as inward pressure is applied to arm 32 in the direction of arrow "A", arm 34 will tend to bulge as hinge 36 moves "over center" of the line passing through pivots 38. This arrangement gives a considerable spring/snapping action to the unitary operating structure.

The above structural arrangement and operation of the dispensing closure system 10 in FIGS. 1 and 2 render the system extremely easy to operate, even by use of an individual's single hand. In other words, the container or bottle can be held while simultaneously applying pressure to arm 32 in the direction of arrow "A" by a finger on the same hand of the user. In addition, closure member 40 can be seen in FIG. 1 to be void of any significant portions projecting radially outwardly of spout 22, in order to render the mechanism child resistant and prevent ready lifting of the closure member.

Figure 3:
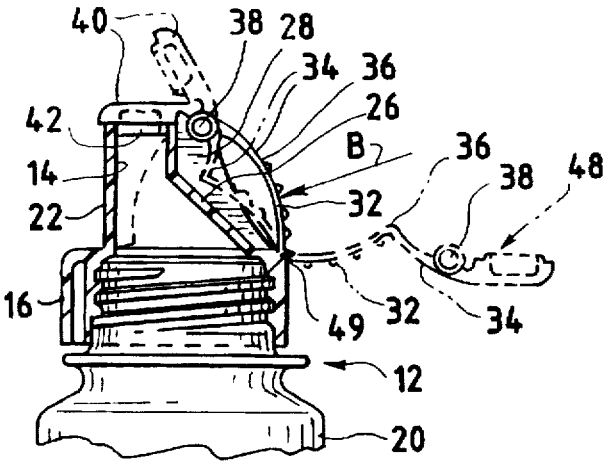
FIG. 3 is a view similar to that of FIG. 1, but of a second embodiment of the invention.
Figure 4:
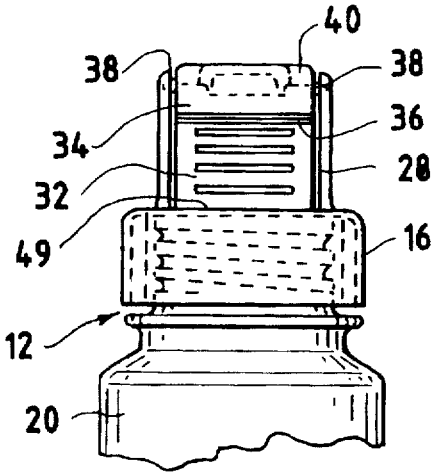
FIG. 4 is a side elevational view of the embodiment of FIG. 3.

FIGS. 3 and 4 show an alternate embodiment of the invention, and like numerals have been applied in these figures corresponding to like components described above in relation to the embodiment of FIGS. 1 and 2. The embodiment of FIGS. 3 and 4 shows how the dispensing closure system can be substantially identically constructed but arranged so as to face more to the side of the container than to the top of the container as in the embodiments of FIGS. 1 and 2. In other words, substantial sideways pressure can be applied to arm 32 in the direction of arrow "B" (FIG. 3) to operate the dispensing closure system identical to the operation as described above in relation to FIGS. 1 and 2. With the embodiment of FIGS. 3 and 4, an individual can hold the container in one hand and apply pressure in the direction of arrow "B" by the individual's thumb of that same hand. With some individuals, more strength may exist in the thumb than in the first or other finger. In addition, this more vertical arrangement of the structural elements provides for the special capability of this device to be conveniently actuated by the user by simply squeezing the cap, front to back, using two fingers, thumb and first finger, of the same hand which is holding the container.

In the embodiment of FIGS. 3 and 4, a feature of the invention is shown wherein the unitarily molded structure 49 is molded integrally with cap 16 rather than being a separate molded structure. In other words, while the end of arm 34 has the snap-in pivots 38, the end of arm 32 is integrally molded to the cap, as at 49. Therefore, this entire structure is threaded onto the neck of the bottle. After molding, structure 48 would project outwardly of the cap as shown in dotted lines in FIG. 3. Snap-in pivots 38 then will be assembled to the cap whereupon the operating structure will be in its position as shown in full lines in FIG. 3.

Figure 5:
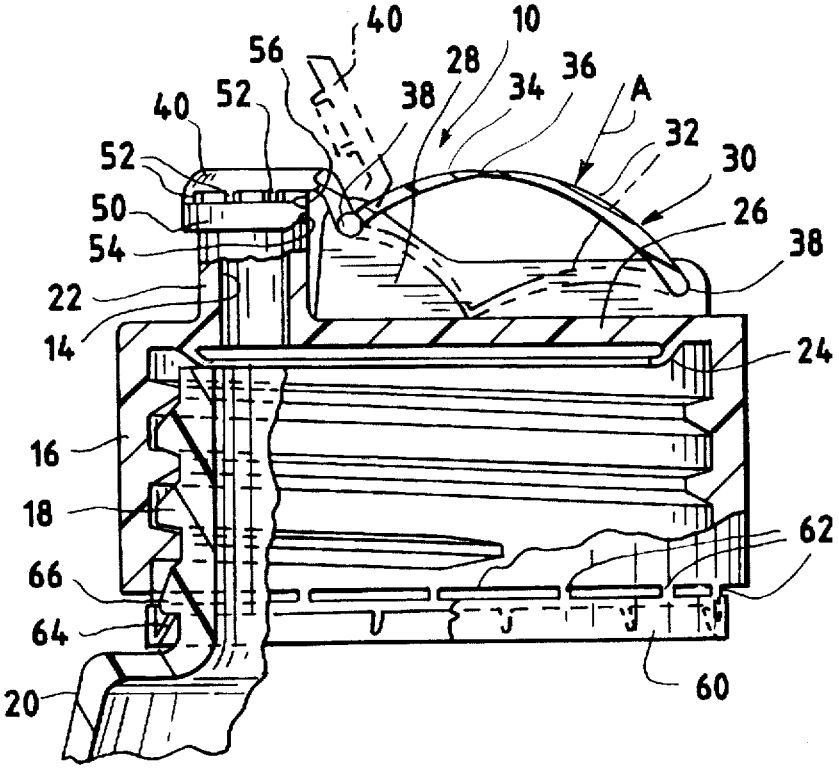
FIG. 5 is a view similar to that of FIG. 1, incorporating the additional features of tear-away tamper proof bands between the cap and the bottle as well as between the closure member and the cap.

FIGS. 5 is a view similar to that of FIG. 1, but showing that the dispensing closure system 10 of the invention is readily applicable for use with a tear-away tamper proof band 50 interconnected between closure member 40 and the top of spout 22 about opening 14. This band commonly is termed a tamper evident band. The band is integrally molded with the underside of closure member 40 by means of thin, frangible bridges or webs 52. The band has an integral, inwardly directed lip 54 which seats under an integral, outwardly directed flange 56 about spout 22. The interengagement of lip 54 with flange 56 prevents closure member 40 from opening until the tamper evident band is broken away from the closure member. Other cross-sectional shapes of tamper-evident bands may also be used.

Similarly, a tamper evident band 60 is interconnected to the bottom of cap 16 by frangible bridges or webs 62. Band 60 has a peripheral lip 64 which seats under a peripheral flange 66 on the outside of neck 16 of bottle 20 to prevent the cap from being removed until band 60 is broken away.

Figure 6:
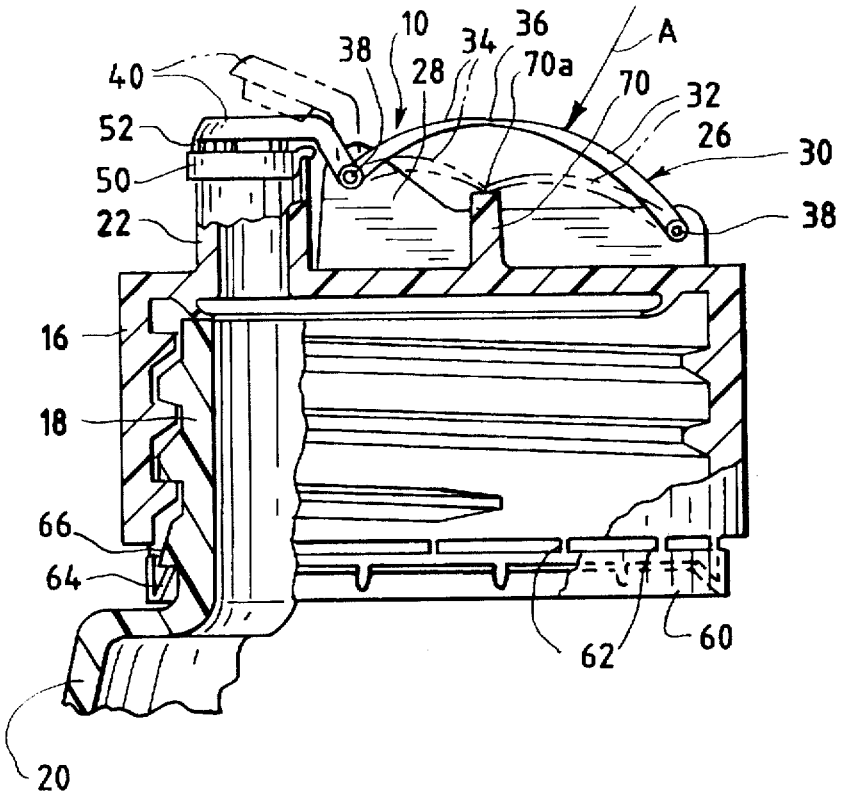
FIG. 6 is a view similar to that FIG. 5, but showing a further embodiment wherein the movement of the closure member and its operating structure are limited to define sort of a spring arrangement.

FIG. 6 shows an alternate embodiment of the invention wherein an upwardly protruding rib 70 is molded integrally with top wall 26 of cap 16. The top surface 70*a* of protruding rib 70 projects upwardly beyond the "over center" line which passes through the spaced apart pivots 38 at opposite ends of arms 32 and 34. Therefore, when pressure is applied to arm 32 in the direction of arrow "A", hinge 36 is prevented from passing through its "over center" position. With this structure, closure member 40 would open less wide than in the embodiment of FIG. 1, but the closure member would return automatically to its closed position when finger pressure is released from operating structure 30. The closure member would not be required to be pushed manually back to its closed position as a separate operation.

The embodiment of FIG. 6 would be useful for dispensing certain liquids as, for example, dishwashing detergents, shampoos and the like which frequently are contained in "squeeze bottles" and which frequently are left open, subjecting the contents to caking or drying out.

Figure 7:
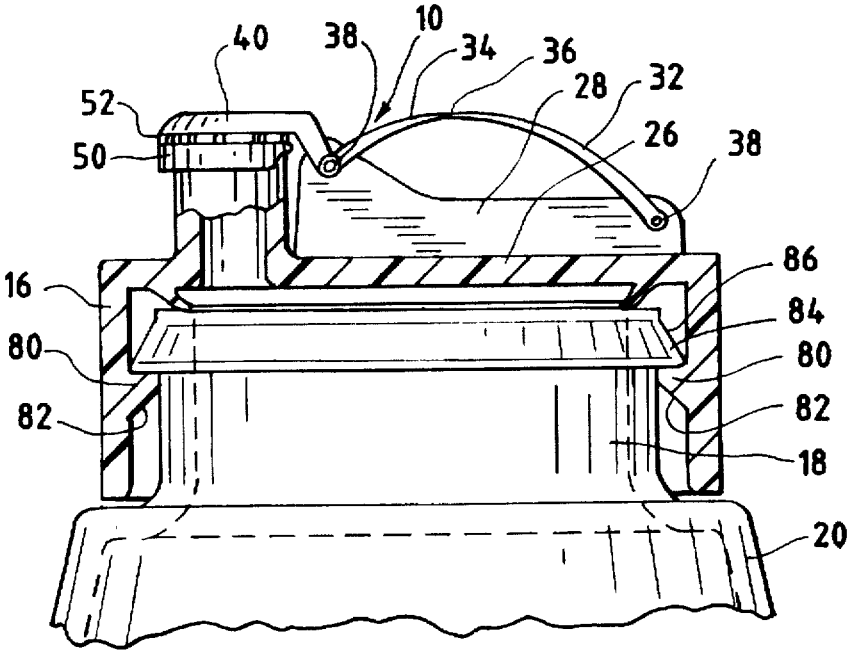
FIG. 7 is a view similar to that of FIG. 5, but showing another embodiment wherein the cap is snapped onto the bottle by interlocking beads.

Lastly, FIG. 7 shows still another embodiment of the invention wherein the cap is snapped onto the bottle by interlocking beads, thereby eliminating the use of screw threads. Again, like numerals have been applied in FIG. 7 corresponding to like components described above in relation to the previous figures. In embodiment of FIG. 7, an interior, integrally molded circular bead 80 projects inwardly of cap 16. The bead has a tapered or chamfered lower surface 82 for snapping over an outwardly projecting bead 84 at the top of neck 18 of bottle 20. The peripheral bead 84 has a chamfered top surface 86 to facilitate snapping bead 80 of the cap thereover. This embodiment provides a substantially child-proof arrangement to prevent removal of the cap from the bottle.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A dispensing closure system for a container having an opening through which the contents of the container are dispensed, comprising:

a unitary operating structure mounted on one side of said opening and including first and second arms connected together by an integral hinge at adjacent ends of the arms, the opposite ends of the arms being secured to the container at spaced apart pivots, the arms and the hinge being constructed and arranged to permit the arms and the hinge to be moved between a first stable position with the hinge disposed outside a line passing through the spaced apart pivots and a second stable position with the hinge disposed inside said line; and a closure member fixed to one of said arms for pivotal movement between a first position closing said opening in the container when the arms and the hinge are in said first stable position, and a second position spaced outwardly of the opening when the arms and the hinge are in said second stable position, whereby the closure member is opened by pushing inwardly on the arms of the operating structure in a direction opposite the opening direction of the closure member.

2. The dispensing closure system of claim 1 wherein said operating structure, including the arms and the hinge thereof, is unitarily molded of plastic material.

3. The dispensing closure system of claim 2 wherein said closure member is molded integrally with said one arm.

4. The dispensing closure system of claim 1 wherein said arms are gradually thinner in cross section for at least part of the distance from the pivot ends of the arms to said hinge.

5. The dispensing closure system of claim 1 wherein said opening in the container is bounded by a lip, and said closure member is void of any portion thereof projecting significantly outwardly of the lip.

6. The dispensing closure system of claim 1 wherein said container includes a bottle and a cap, with said opening being in the cap, and said unitary operating structure being mounted on the cap.

7. The dispensing closure system of claim 6 wherein the arms of said unitary operating structure are pivotally mounted between a pair of upstanding walls on the top of said cap.

8. The dispensing closure system of claim 7, including snap-latch means between the unitary operating structure and said upstanding walls to define said spaced apart pivots.

9. The dispensing closure system of claim 8 wherein said snap-latch means comprise pivot detents on one of the unitary operating structure and the upstanding walls, the detents being snapped into pivot recesses on the other of the unitary operating structure and the upstanding walls.

10. The dispensing closure system of claim 6, including a tear-away tamper proof band interconnected between the cap and the bottle.

11. The dispensing closure system of claim 6, including interlocking beads between the cap and the bottle to provide a tamper-proof and child-resistant snap-latch structure therebetween.

12. The dispensing closure system of claim 6 wherein said operating structure, including the arms and the hinge thereof, along with said closure member, is unitarily molded of plastic material, and with an end of the other of said arms being molded integrally with the cap.

13. The dispensing closure system of claim 1, including a tear-away tamper proof band interconnected between the closure member and the container.

14. A dispensing closure system for a container having an opening through which the contents of the container are dispensed, comprising:

a unitary operating structure mounted on one side of said opening and including first and second arms connected together by an integral hinge at adjacent ends of the arms, the opposite ends of the arms being secured to the container at spaced apart pivots, the arms and the hinge being constructed and arranged to permit the arms and the hinge to be moved between a first stable position with the hinge disposed outside a line passing through the spaced apart pivots and a second stable position with the hinge disposed inside said line, said operating structure including the arms and the hinge thereof being unitarily molded of plastic material with the closure member molded integrally with said one arm, and the arms being gradually thinner in cross section for at least part of the distance from the pivot ends of the arms to the hinge; and a closure member fixed to one of said arms for pivotal movement between a first position closing said opening in the container when the arms and the hinge are in said first stable position, and a second position spaced outwardly of the opening when the arms and the hinge are in said second stable position, whereby the closure member is opened by pushing inwardly on the arms of the operating structure in a direction opposite the opening direction of the closure member.

15. The dispensing closure system of claim 14 wherein said opening in the container is bounded by a lip, and said closure member is void of any portion thereof projecting significantly outwardly of the lip.

16. The dispensing closure system of claim 14 wherein said container includes a bottle and a cap, with said opening being in the cap, and said unitary operating structure is mounted on the cap.

17. The dispensing closure system of claim 16 wherein the arms of said unitary operating structure are pivotally mounted between a pair of upstanding walls on the top of said cap.

18. The dispensing closure system of claim 17, including snap-latch means between the unitary operating structure and said upstanding walls to define said spaced apart pivots.

19. The dispensing closure system of claim 18 wherein said snap-latch means comprise pivot detents on one of the unitary operating structure and the upstanding walls, the detents being snapped into pivot recesses on the other of the unitary operating structure and the upstanding walls.

20. The dispensing closure system of claim 16, including a tear-away tamper proof band interconnected between the cap and the bottle.

21. The dispensing closure system of claim 16, including interlocking beads between the cap and the bottle to provide a tamper-proof and child-resistant snap-latch structure therebetween.

22. The dispensing closure system of claim 16 wherein said operating structure, including the arms and the hinge thereof, along with said closure member, is unitarily molded of plastic material, and with an end of the other of said arms being molded integrally with the cap.

23. The dispensing closure system of claim 14, including a tear-away tamper proof band interconnected between the closure member and the container.

24. A dispensing closure system for a container having an opening through which the contents of the container are dispensed, comprising:

a unitary operating structure mounted on one side of said opening and including first and second arms connected together by an integral hinge at adjacent ends of the arms, the opposite ends of the arms being secured to the container at spaced apart pivots;

stop means on the container to prevent said hinge from passing through a line intersecting the spaced apart pivots; and a closure member fixed to one of said arms for pivotal movement therewith to open and close said opening, whereby the closure member is opened by pushing inwardly on the arms of the operating structure in a direction opposite the opening direction of the closure member and the closure member returns automatically to its closed position when pushing pressure on the arms is released.

* * * * *